United States Patent [19]

Clark, Jr. et al.

[11] Patent Number: 4,703,936

[45] Date of Patent: Nov. 3, 1987

[54] SEALOFF DEVICE AND METHOD FOR CONTROLLING THE LEVEL OF A FLUID WITHIN FIRST AND SECOND COMMUNICATING CONFINED REGIONS

[75] Inventors: Roy A. Clark, Jr., Mt. Lebanon; Howard W. Yant, Greensburg, both of Pa.

[73] Assignee: Westinghouse Electric Corp., Pittsburgh, Pa.

[21] Appl. No.: 670,789

[22] Filed: Nov. 13, 1984

[51] Int. Cl.[4] ..... F16J 15/00; F16J 15/46; G21C 19/20

[52] U.S. Cl. ..... 277/1; 137/1; 277/9; 277/12; 277/15; 277/34.3; 277/135; 376/203; 376/287

[58] Field of Search ..... 277/1, 9, 12, 32, 34.3, 277/135, 15; 137/15, 264, 571, 1; 134/166 R, 114, 186; 376/203, 402, 403, 404, 406, 361, 287, 206, 210, 217; 405/147, 135, 141, 144, 41, 115, 52, 11, 4, 65, 68, 87, 91, 107, 53; 220/428, 469, 225, 228, 219; 250/431, 435, 438; 166/142, 387; 122/379, 397, 235 G, 406 R

[56] References Cited

U.S. PATENT DOCUMENTS

| | | | |
|---|---|---|---|
| 216,064 | 6/1879 | Spencer | 166/142 X |
| 1,874,726 | 8/1932 | Wiggins | 220/219 |
| 1,979,272 | 11/1934 | Kramer | 220/219 |
| 2,133,730 | 10/1938 | Brundred . | |
| 2,306,160 | 12/1942 | Freyssinet . | |
| 3,024,613 | 3/1962 | Calciano, Sr. | 405/41 |
| 3,038,732 | 6/1962 | Scott et al. | 277/34.3 |
| 3,171,675 | 3/1965 | Calciano, Jr. | 405/41 X |
| 3,202,584 | 8/1965 | Bogaardt et al. | 376/210 |
| 3,293,137 | 12/1966 | Hutchinson | 376/210 |
| 3,324,007 | 6/1967 | Baxter . | |
| 3,401,082 | 9/1968 | Ammon et al. | 376/406 X |
| 3,417,830 | 12/1968 | Nichols | 166/142 X |
| 3,497,103 | 2/1970 | Brady et al. | 220/219 |
| 3,597,926 | 8/1971 | Riddett | 405/115 |
| 3,698,724 | 10/1972 | Blachere et al. . | |
| 3,713,972 | 1/1973 | Coast et al. . | |
| 3,717,352 | 2/1973 | Jansing et al. . | |
| 3,847,453 | 11/1974 | Herbert . | |
| 4,068,852 | 1/1978 | Anglade . | |
| 4,135,973 | 1/1979 | Golden . | |
| 4,239,245 | 12/1980 | Giglio et al. | 277/203 |
| 4,362,694 | 12/1982 | Kayser | 376/361 X |

FOREIGN PATENT DOCUMENTS

| | | | |
|---|---|---|---|
| 68740 | 6/1977 | Japan | 277/34 |

*Primary Examiner*—Allan N. Shoap

[57] ABSTRACT

A sealoff device and method are disclosed for controlling the level of a fluid within first and second confined regions which are arranged in fluid communication with one another. In the preferred embodiment, the invention permits shielding of the tube bundle contained within the wrapper of a nuclear steam generator while controlling the level of the working fluid within the surrounding annular downcomer passage. A sealoff device constructed of a flexible hollow tube is provided in sealing engagement between the wrapper and outer shell forming the downcomer passage to provide a substantially fluid-tight seal thereat. The sealoff device permits the maintaining of a high water level inside the wrapper to shield the tube bundle which is emitting nuclear radiation while maintaining a low water level within the downcomer passage to permit greater accessibility for repair and maintenance of the steam generator in a dry environment and to permit greatly increased working time in a greatly reduced radiation field.

19 Claims, 1 Drawing Figure

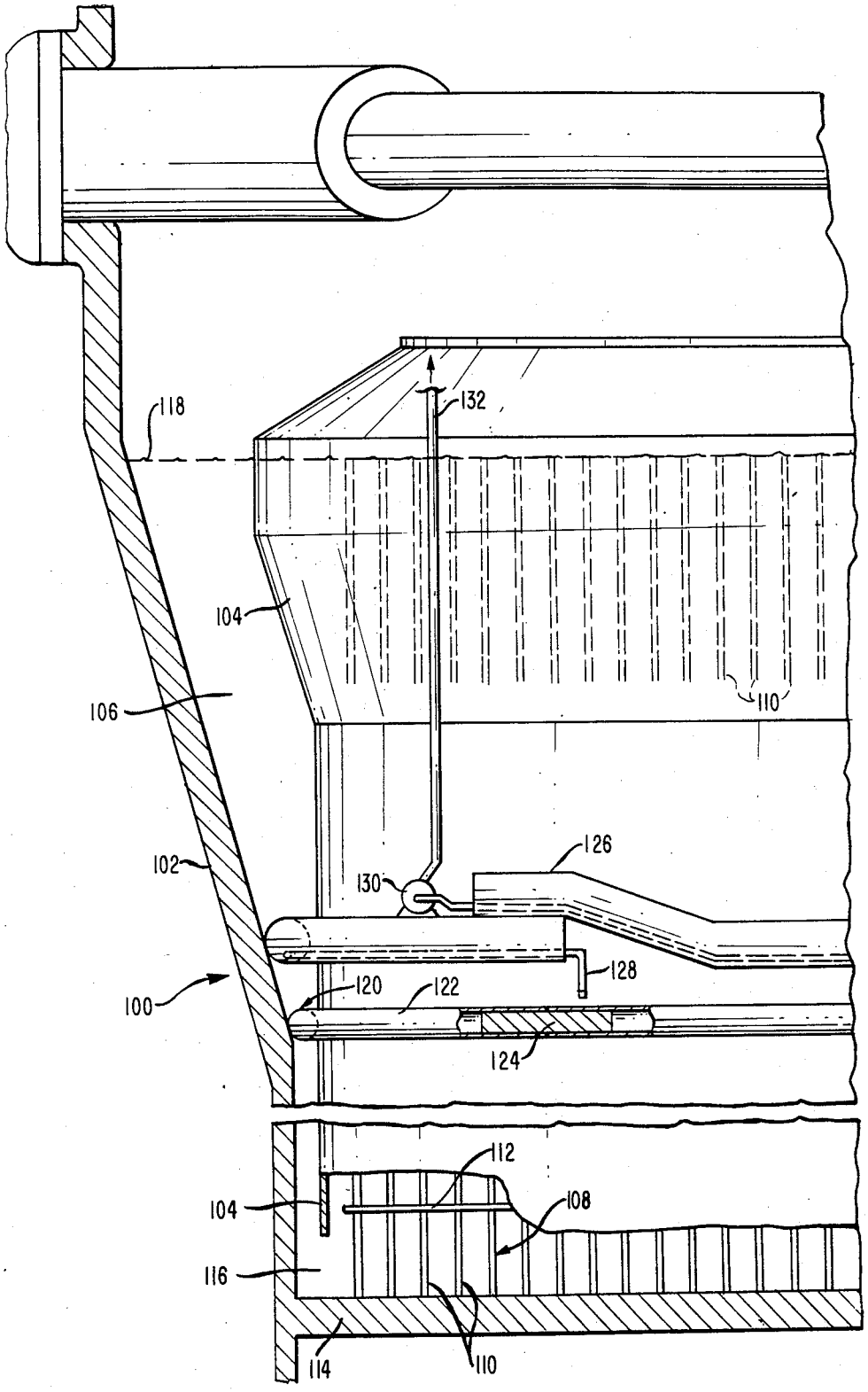
118
132
104
110
106
126
102
130
128
120
122
100
124
112
104
108
116
114
110

SEALOFF DEVICE AND METHOD FOR CONTROLLING THE LEVEL OF A FLUID WITHIN FIRST AND SECOND COMMUNICATING CONFINED REGIONS

BACKGROUND OF THE INVENTION

1. Field of the Invention

The present invention relates in general to a sealoff device and method for controlling the level of a fluid within first and second confined regions arranged in fluid communication with one another, and more particularly, to such a device and method adapted to shielding, from nuclear radiation, a tube bundle contained within the wrapper of a nuclear steam generator by controlling the level of a shielding media, i.e., water, within the interior of the wrapper and while maintaining the annular downcomer passage free of the shielding media above a predetermined elevation to permit dry access therein.

2. Description of the Prior Art

The generation of electrical power using nuclear energy requires the use of a steam generator for conversion of a working fluid, i.e., water, into pressurized steam. The steam generator is generally constructed of a tube bundle having a plurality of heat transfer tubes extending from a supporting tube sheet and contained within a cylindrical wrapper which defines an annular downcomer passage between a concentric outer shell. A mixture of fresh feed water and return water from a liquid/vapor separator enters the tube bundle area through openings in the wrapper at the end of the annular downcomer passage near the tubesheet. This fluid is on the outside of the tubes and is not normally contaminated. Particular radiation emitting contaminants are deposited on the inside of the tubes from primary water that is heated in the reactor core. These primary system contaminates give off a relatively high radiation field. The annular downcomer passage between the outer shell and wrapper of the nuclear steam generator is accordingly subjected to such a high radiation field as a result of these deposited radioactive contaminants.

During the operating life of the steam generator, it is periodically required that access be gained to the annular downcomer passage for internal repair and/or maintenance. In order for an operator to work within the area of the annular downcomer passage for long periods without exceeding relatively low government radiation limits, it is required that the tube bundle within the wrapper be effectively shielded by, for example, raising the water level to entirely cover the tube bundle. As is well-known, water provides one of the more effective shielding media for nuclear radiation. However, as the water level rises over the tube bundle, so does the water level within the annular downcomer passage as a result of their being constructed in fluid communication with one another. The performing of work of any nature within the annular downcomer passage while it is under a high water level condition, creates problems of safety to the operator and inaccessibility to the lower regions of the downcomer passage. If the water level is lowered in the annular downcomer passageway to increase accessibility and to permit work to be performed in a dry environment, the water level about the tube bundle is lowered a corresponding amount. As a consequence, a portion of the tube bundle becomes unshielded, causing the work area to be subjected to a high radiation field. This high radiation field created in the work area will decrease the work time allowed within the limits of allowable government radiation exposure for these workers.

Accordingly, it can be appreciated that there is an unsolved need for a sealoff device and method which permits the maintaining of a high water level inside the wrapper of a steam generator for shielding workers from the radiation source contained tube bundle, while providing a dry work area within the annular downcomer passage, which in addition to being greatly reduced in exposure to the radiation field, provides for greater accessibility to the exterior of the wrapper for repair and maintenance.

SUMMARY OF THE INVENTION

It is broadly an object of the present invention to provide a sealoff device and method for controlling the level of a radiation shielding media within first and second confined regions which are arranged in fluid communication with one another, and which fulfills the specific requirements of such a device and method for providing a dry working environment in a portion of the first confined region, as well as providing increased accessibility therein. Specifically, it is within the contemplation of one aspect of the present invention to provide a sealoff device and method for shielding the tube bundle contained within the wrapper of a steam generator while controlling the level of the fluid within the surrounding annular downcomer passage to provide a dry working environment and one which has greatly reduced radiation.

Another object of the present invention is to provide a sealoff device which is of simple construction and which is easy to install in providing a substantially fluid-tight seal.

Another object of the present invention is to provide a sealoff device and method for permitting dry accessibility to the lower region of the annular downcomer passage of a nuclear steam generator.

In accordance with one embodiment of the present invention, there is disclosed a sealoff device for controlling the level of a fluid within first and second confined regions arranged in fluid communication with one another. The sealoff device is constructed of a seal member arranged within the second confined region and adapted to maintaining the level of the fluid substantially thereat while permitting the fluid within the first confined region to be maintained at a predetermined level above the seal member.

Further in accordance with the above embodiment, the first confined region is provided by a housing having a longitudinal axis arranged in a vertical orientation, the second confined region is provided by a shell concentrically arranged about the housing so as to define an annular region therebetween, and the seal member comprises a continuous tube arranged within the annular region and in contact with the housing and the shell to form a substantially fluid-tight seal thereat.

Further in accordance with the above embodiment, there is provided blocking means constructed of a hollow tube within the second confined region constructed and arranged for preventing passage thereby of solid material and including siphoning means within the hollow tube and communicating between a location adjacent the seal member and a location remote therefrom.

In accordance with another embodiment of the present invention, there is provided a sealoff device for controlling the level of a fluid within confined regions, the confined regions including means for defining a first region for containing a fluid at a predetermined level, and means for defining a second region for containing the fluid, the second region being in fluid communication with the first region, such that the level of the fluid within the first region corresponds to the level of the fluid in the second region. The sealoff device is constructed of a tube arranged within the second region for maintaining the fluid within the first region at the predetermined level while maintaining the fluid within the second region below the predetermined level.

In accordance with still another embodiment of the present invention, there is provided a method for controlling the level of a fluid within first and second confined regions arranged in fluid communication with one another. The method comprises the steps of arranging a seal member within the second confined region at a first predetermined level to maintaining the level of the fluid substantially thereat and maintaining the fluid within the first confined region at a second predetermined level above the first predetermined level.

BRIEF DESCRIPTION OF THE DRAWING

The above description, as well as further objects, features and advantages of the present invention, will be more fully understood by reference to the following detailed description of the presently preferred, but nonetheless illustrative, sealoff device and method for controlling the level of a fluid within first and second confined regions arranged in fluid communication with one another, in accordance with the present invention, when taken in conjunction with the accompanying sole drawing. The sole drawing discloses, in partial cross-section, an upper portion of a nuclear steam generator and showing the sealoff device of the present invention and its attendant method of use.

DETAILED DESCRIPTION OF THE PREFERRED EMBODIMENTS

Referring now to the sole drawing, wherein like reference numerals represent like elements, there is shown in the drawing a portion of a nuclear steam generator generally designated by reference numeral 100. The steam generator 100 is constructed of a cylindrical outer shell 102 and an inner concentric cylindrical wrapper 104, which defines therebetween an annular downcomer passage 106 having an upper portion as shown of tapered cross-section. Contained by the cylindrical wrapper 104 is a tube bundle 108 constructed generally of a plurality of heat transfer tubes 110, and maintained in fixed spaced relationship by a plurality of parallel spaced-apart flow distribution support baffles 112. The flow distribution support baffles 112 are each provided with a plurality of openings through which the heat transfer tubes 110 pass. The lower ends of the heat transfer tubes 110 extend through a tube sheet 114 and communicate with a supply of a heating fluid for the heat transfer tubes. The lower end of the wrapper 104 terminates above the tube-sheet 114 to provide an opening 116 communicating between the annular downcomer passage 106 and the lower portion of the tube bundle 108.

As previously noted, a mixture of fresh feed water and return water from a liquid/vapor separator (not shown) enters the tube bundle area 108 through the opening 116 in the wrapper 104 at the lower end of the downcomer passage 106 near the tubesheet 114. As evidenced from the construction of the steam generator 100, the water level within the wrapper 104 corresponds to the water level within the downcomer passage 106 due to their being in fluid communication with one another via the opening 116. In order to fully shield the tube bundle 108, it will be required that the water level within the wrapper 104 and downcomer passage 106 be raised to the general level indicated by the broken lines 118. However, at a water level indicated by broken lines 118, the entire downcomer passage 106 is also maintained under water and therefore inaccessible for repair and maintenance. On the other hand, if the water level within the downcomer passage 106 is lowered to provide a dry working area, the water level within the wrapper 104 is lowered a corresponding amount so as to expose a portion of the tube bundle 108. This condition results in operator exposure to a strong radiation field from the tube bundle 108. As operator exposure to the high radiation field reduces allowable working time, it is an important advantage to greatly reduce radiation levels. In this regard, the sealoff device and method of the present invention allows for the water level to be maintained within the wrapper 104 above the tube bundle 108 at or above the 118 level while allowing the water level in the downcomer passage 106 to be maintained at a lower level so as to provide a dry working area.

As shown in the drawing, the sealoff device 120 is constructed of a thick-walled hollow flexible rubber tube 122 joined at its ends by means of an insert 124 to form a circular seal. In joining the ends of the tube 122, the internal diameter of the tube is dimensioned slightly smaller than the external diameter of the insert 124 to provide a friction fit. This friction fit is sufficient to maintain the ends of the tube 122 in abutting engagement and the formation of a circular seal therefrom. Although the tube 122 has been described as being constructed of a hollow tube joined together at its ends by an insert 124, it is contemplated that a solid rubber hose joined at its end by other means can also be employed. To this end, it is only required that the diameter of the circular seal created by the tube 122 correspond to the diameter of the opening into which the tube is to be inserted; and that the cross-sectional diameter of tube 122 be somewhat greater than the gap into which it is inserted, i.e., between the inner surface of the outer shell 102 and the outer surface of the wrapper 104. In the embodiment illustrated, the sealoff device 120 comprises a three inch diameter tube 122 having its ends joined to form a circular seal of sufficient diameter for circumscribing the wrapper 104 within the downcomer passage 106 at the location desired.

The tube 122, as a result of its construction of thick-walled rubber material, possess sufficient stiffness to enable it to be forced into the downcomer passage 106 to form a substantially fluid-tight seal between the outer shell 102 and the wrapper 104. The upward force on the tube 122 exerted by water contained within the lower portion of the downcome passage 106 will be counteracted by the friction of the tube against the outer shell 102 and wrapper 104. Additionally, weights (not shown) may be distributed within the interior of the tube 122 or uniformly about its upper surface to hold the tube in fluid-tight sealing engagement with the outer shell 102 and wrapper 104. It is further contemplated that the tube 122 can be designed to be inflated with compressed air to provide a more positive seal in the manner as thus far described.

With the sealoff device 120 tightly wedged between the outer shell 102 and wrapper 104, a fluid-tight seal is provided thereat for maintaining the downcomer passage 106 free from water in the work area while allowing the water level within the wrapper 104 to completely cover the tube bundle 108 to provide an effective radiation shield. The operator may now work in a completely dry environment, having a high degree of access to the downcomer passage 106, for repair and/or maintenance, while being subjected to greatly reduced exposure to nuclear radiation from the tube bundle 108. Once the operator has completed working in the downcomer passage 106, the seal device 120 may simply be removed, the water level stabilized, and the steam generator 100 may be returned to its normal operation. Accordingly, it can be appreciated that the sealoff device 120 of the present invention greatly simplifies the ability of an operator to perform work in the area of a downcomer passage 106 while being free from exposure to higher levels of nuclear radiation.

While working within the steam generator 100, tools, small parts and foreign material, such as weld slag and burning slag, often fall into the downcomer passage 106. In order to prevent accumulation of the foregoing on the sealoff device 120, as well as preventing injury to the tube 122, a flexible stainless steel hollow tube 126 is provided within the downcomer passage 106 circumscribing the wrapper 104 at a location slightly above the sealoff device 120. In this regard, the diameter of the tube 126 will be greater than the diameter of the tube 122 due to the tapered nature of the downcomer passage 106. In accordance with one embodiment of the present invention, the tube 126 is found to have a diameter of about five inches, while tube 122 is of about three inches.

Unlike the tube 122, it is not required that the ends of the tube 126 be joined in end-to-end relationship. As illustrated, the ends of the tube 126 are merely arranged in overlapping relationship so that their free ends remain unconnected. In addition to the tube 126 providing a blockage for foreign material falling into the downcomer passage 106, the tube also provides a platform within the downcomer passage to be walked upon by the operator while working within the steam generator 100. This prevents the opeator from stepping on the sealed device 120 with the possible consequence of disrupting its sealing engagement with the outer shell 102 or wrapper 104.

Once work has been completed within the steam generator 100, the foreign material captured by the tube 126 may be removed by local sweeping and/or vacuuming in a dry environment without exposure to high radiation from the tube bundle 108. Although the tube 126 has been described as constructed of stainless steel material, other materials of a rigid nature may be employed. In addition, the tube 126 is required only to be sufficiently long to circumscribe the wrapper 104 and to provide an overlapping portion as illustrated. As the diameter of the tube 126 corresponds to the space between the outer shell 102 and wrapper 104 at its installed location, such diameter will be required to be increased should the tube be installed at a higher location to accommodate the tapered nature of the downcomer passage 106, much in the manner of the tube 122.

Although the sealoff device 120 has been described as providing a fluid-tight seal between the outer shell 102 and wrapper 104 within the downcomer passage 106, it is not required that the seal be perfect. Slight leakage of water past the sealoff device 120 can be accommodated by providing a siphoning tube 128 extending through the tube 126. As illustrated, one end of the siphoning tube 128 is positioned adjacent the upper surface of the sealoff device 120, while its other end is connected to a pump 130. Water leaking past the sealoff device 120 is sucked up by the pump 130 using the siphoning tube 128 and discharged through its outlet end 132, for example, to a swirl vane assembly (not shown) which includes a hole in the wrapper 104 to allow recirculating of water to within the confines of the wrapper 104. The pump 130 may be of conventional design, and depending upon its style, it may be arranged on top of the tube 126, as illustrated, for low suction head, or when of the submersible type, can be arranged resting on top of the sealoff device 120.

There has thus far been described a sealoff device in accordance with the present invention for maintaining the level of a fluid within a steam generator for shielding a tube bundle provided therein, the steam generator including a wrapper surrounding the tube bundle and an outer shell surrounding the wrapper to provide an annular downcomer passage therebetween in fluid communication with the interior of the wrapper. The sealoff device is constructed of a circular seal member arranged circumscribing the wrapper within the annular downcomer passage. The seal member arranged in sealing engagement with the wrapper and the outer shell to provide a substantially fluid-tight seal thereat, the seal member maintaining the level of the fluid within the interior of the wrapper at a predetermined level above that of the fluid-tight seal within the annular downcomer passage, whereby the fluid at the predetermined level shields the tube bundle while being maintained within the annular downcomer passage at substantially the level of the fluid-tight seal.

There has also been described a method in accordance with the present invention, for shielding with a fluid a tube bundle contained within a wrapper of a steam generator while controlling the level of the fluid within a surrounding annular downcomer passage arranged in fluid communication with the interior of the wrapper. The method comprises the steps of inserting a seal member within the downcomer passage to provide a substantially fluid-tight seal thereat, supplying the fluid to the interior of the wrapper, and maintaining the level of the fluid within the interior of the wrapper at a predetermined level above that of the fluid-tight seal for shielding the tube bundle.

Although the invention herein has been described with reference to particular embodiments, it is to be understood that these embodiments are merely illustrative of the principles and application of the present invention. For example, the sealoff device of the present invention can be employed with other than steam generators for controlling the level of a fluid within first and second confined regions which are arranged in fluid communication with one another. It is therefore to be understood that numerous modifications may be made in the illustrative embodiments and that other arrangements may be devised without departing from the spirit and scope of the present invention as defined by the appended claims.

We claim as our invention:

1. A sealoff device for controlling the level of a fluid within confined regions, said confined regions including means for defining a first region for containing a fluid at a predetermined level, and means for defining a second region for containing said fluid, said second region being in fluid communication with said first region such that the level of said fluid within said first region corresponds to the level of said fluid in said second region, said sealoff device comprising a first tube arranged within said second region for maintaining said fluid within said first region at said predetermined level while maintaining said fluid within said second region below said predetermined level, a hollow second tube arranged above said first tube, and siphoning means within said hollow second tube communicating between a location above said first tube and a location remote therefrom.

2. The sealoff device of claim 1 wherein said second region comprises an annular region arranged concentrically about said first region.

3. The sealoff device of claim 2 wherein said annular region communicates with said first region at a common end of said first and second regions.

4. The sealoff device of claim 3 wherein said predetermined level is at an elevation above said common end.

5. The sealoff device of claim 1 wherein said means for defining said first region comprises a housing having a longitudinal axis arranged in a vertical orientation.

6. The sealoff device of claim 5 wherein said means for defining said second region comprises a shell concentrically arranged about said housing so as to define an annular region therebetween.

7. The sealoff device of claim 6 wherein said housing includes an opening providing fluid communication between the interior of said housing and said annular region.

8. The sealoff device of claim 6 wherein said first tube comprises a continuous hollow tube arranged within said annular region and in contact with said housing and said shell to form a substantially fluid-tight seal thereat.

9. The sealoff device of claim 8 wherein said fluid-tight seal is at an elevation below said predetermined level.

10. The sealoff device of claim 1 wherein said first tube is arranged continuously circumscribing said first region.

11. The sealoff device of claim 10 wherein said first tube is inflatable.

12. The sealoff device of claim 1 wherein said hollow second tube includes open ends arranged overlapping one another to form a continuous blockage within said second region circumscribing said first region.

13. The sealoff device of claim 1 further including a pump connected to said siphoning means for evacuating said fluid above said first tube and returning the evacuated fluid to said second region.

14. A sealoff device for maintaining the level of a fluid within a steam generator for shielding a tube bundle provided therein, said steam generator including a wrapper surrounding said tube bundle and an outer shell surrounding said wrapper to provide an annular downcomer passage therebetween in fluid communication with the interior of said wrapper, said sealoff device comprising a circular seal member arranged circumscribing said wrapper within said annular downcomer passage, a hollow tube arranged above said seal member for preventing the downward passage of solid material within said annular downcomer passage, and siphoning means within said hollow tube communicating between a location above said seal member and a location remote therefrom, said seal member arranged in sealing engagement with said wrapper and said outer shell to provide a substantially fluid-tight seal thereat, said seal member maintaining the level of said fluid within the interior of said wrapper at a predetermined level above that of said fluid-tight seal within said annular downcomer passage, whereby said fluid at said predetermined level shields said tube bundle while being maintained within said annular downcomer passage at substantially the level of said fluid-tight seal.

15. The sealoff device of claim 14 wherein said seal member comprises a continuous flexible tube.

16. The sealoff device of claim 14 further including a pump connected to said siphoning means for evacuating said fluid above said seal member and returning the evacuated fluid to the interior of said wrapper.

17. The sealoff device of claim 14 wherein said seal member is inflatable for engaging said outer shell and said wrapper.

18. A method for shielding with a fluid a tube bundle contained within a wrapper of a stream generator while controlling the level of said fluid within a surrounding annular downcomer passage arranged in fluid communication with the interior of said wrapper, said method comprising the steps of inserting a seal member within said downcomer passage to provide a substantially fluid-tight seal thereat, supplying said fluid to the interior of said wrapper, maintaining the level of said fluid within the interior of said wrapper at a predetermined level above that of said fluid-tight seal for shielding said tube bundle, and recirculating said fluid from above said seal member within said downcomer passage to the interior of said wrapper.

19. The method of claim 18 further including the step of providing blocking means adjacent said seal member for preventing the passage of solid material within said annular downcomer passage.

* * * * *